United States Patent [19]

Larsen

[11] Patent Number: 4,911,313

[45] Date of Patent: Mar. 27, 1990

[54] LINKAGE LIFTING APPARATUS

[75] Inventor: Robert A. Larsen, Milwaukee, Wis.

[73] Assignee: Harnischfeger Corporation, Brookfield, Wis.

[21] Appl. No.: 281,720

[22] Filed: Dec. 9, 1988

[51] Int. Cl.[4] ..... B66C 11/12; E02B 7/36

[52] U.S. Cl. ..... 212/166; 212/220; 212/221; 294/81.1; 294/81.5; 294/82.26; 405/106

[58] Field of Search ..... 212/166, 220, 221; 405/106; 294/81.1, 81.5, 81.51, 81.56, 82.26

[56] References Cited

U.S. PATENT DOCUMENTS

| | | | |
|---|---|---|---|
| 2,047,141 | 7/1936 | Fildes | 294/81.51 |
| 2,119,547 | 6/1938 | Knerr | 294/81.51 |
| 2,130,354 | 9/1938 | Madsen | 405/106 |
| 2,665,937 | 1/1954 | Reigh | 294/81.51 |
| 2,669,479 | 2/1954 | Louckes | 294/81.51 |
| 3,262,729 | 7/1966 | Willison et al. | 294/81.51 |
| 4,202,576 | 5/1980 | Hasquenoph et al. | 294/82.26 |

FOREIGN PATENT DOCUMENTS

| | | | |
|---|---|---|---|
| 765185 | 9/1980 | U.S.S.R. | 294/81.51 |

*Primary Examiner*—Sherman D. Basinger
*Assistant Examiner*—Thomas J. Brahan
*Attorney, Agent, or Firm*—Richard C. Ruppin

[57] ABSTRACT

A linkage lifting apparatus is disclosed in which a linkage means is mounted on a lifting beam and includes link pivotal connections which may be connected and disconnected from load hooks comprising part of an object to be lifted. The linkage lifting apparatus includes a latching means which holds two link pairs in a position in which the link pivotal connections may engage the load hooks. The latching means is releasable from the link pairs in response to downward movement of the lifting beam against the link pairs. The pivotal connections move into a lifting position in engagement with the hooks in response to force provided by the weight of links comprising part of the two link pairs. The two link pairs and the pivotal connections movable out of the lifting position and the link pairs are again latched by the latching mechanism to hold them free of the load hooks also in response to downward movement of the lifting beam against the link pairs.

17 Claims, 4 Drawing Sheets

LINKAGE LIFTING APPARATUS

FIELD OF THE INVENTION

This invention relates to a linkage lifting apparatus for use with a crane. More particularly, the invention relates to a linkage lifting apparatus which mechanically connects to and releases from an object to be raised and lowered by a crane without manual assistance.

BACKGROUND OF THE INVENTION

In some crane lifting applications it is desirable to be able to connect to and release from the load without manual manipulation of the hook or latching mechanism. This ability is, for example, most critical in gantry cranes operated to raise and lower or lift clear and replace dam gates. In such situations the gate may be below water level or otherwise inaccessible to crane operating personnel. Prior mechanisms for automatically connecting to or disengaging a crane hook or latch without manual intervention are typically of a complicated nature requiring a high level of maintenance and frequently do not operate in an easy, reliable manner. Moreover, a gantry crane for handling dam gates may have its lifting beam submerged in water so that electrical or hydraulic control systems on the lifting cannot be used.

A further problem in cranes having a lifting beam which is positioned between the load object to be raised or lowered and an overhead hoist attached to the beam, such as is typically utilized in gantry cranes, is that the location of the connection of the load object to the beam through the connecting mechanism and the location of attachment of the hoist to the beam are spaced apart along the length of the beam. This space between these two locations results in bending forces on the beam which require it to have increased strength resulting in higher cost and undesired greater weight.

SUMMARY OF THE INVENTION

It is a general object of this invention to provide, in a crane connectable to a load object by means of hooks or similar means on the load object, a simple and reliable apparatus for connecting the crane to and releasing it from the load object without manual assistance. It is a further object of the invention to provide a load object connecting and releasing apparatus for a crane having a lifting beam in which the points of connection of the load to the beam and the points of connection of the beam to the crane hoist supporting the beam are in substantial vertical alignment.

The invention is accomplished by providing a lifting beam of a crane with linkage means held in a first position by latch means in which the linkage means is engageable with hooks on a load object. The linkage means is released by the latch means at a second position of the linkage means to permit the linkage means to move to a third position in which the linkage means is connected to the hooks and the object can be raised by the crane. The crane includes an overhead hoist having wire rope wound on spaced apart sheave means carried by the lifting beam for raising and lowering the lifting beam and thereby the object.

Upon release of the linkage means in its second position, the weight of the links of the linkage means, which include ends having a pivotal connection releasably connected to the latch means, provides a downward force which moves the linkage means to its third position in which it is connected to projections of the hooks. The linkage means includes pivotal connections engaging each of the hooks and connecting the linkage means to the hooks in the third position of the linkage means. When the object is set down on a supporting surface and it is desired to release the object from the crane, the lifting beam is lowered sufficiently to move the pivotal connections out of engagement with the hook projections. At the same time, the linkage means is moved from its third position to a fourth position in which the linkage means is held by the latch means out of engagement with the hook projections. Upon raising of the lifting beam by the crane, the object will remain where it had been previously set down and the crane can move elsewhere to carry out further work.

The pivotal connections of the linkage means which connect the linkage means to the hook projections include links having ends pivotally attached to the lifting beams. The location of each connection with a hook projection is substantially beneath the point of attachment of the link ends to the lifting beams. The sheave means by which the lifting beam is supported by the hoist, are directly above the attachment locations of the link ends to the lifting beam. Thus, the load of the object is carried along substantially a vertical line through the lifting beam to minimize any bending force on the beam due to the load of the object.

BRIEF DESCRIPTION OF THE DRAWINGS

Further objects and advantages of the invention will appear when taken in conjunction with the accompanying drawings, in which.

DETAILED DESCRIPTION OF THE INVENTION

Figure 1:
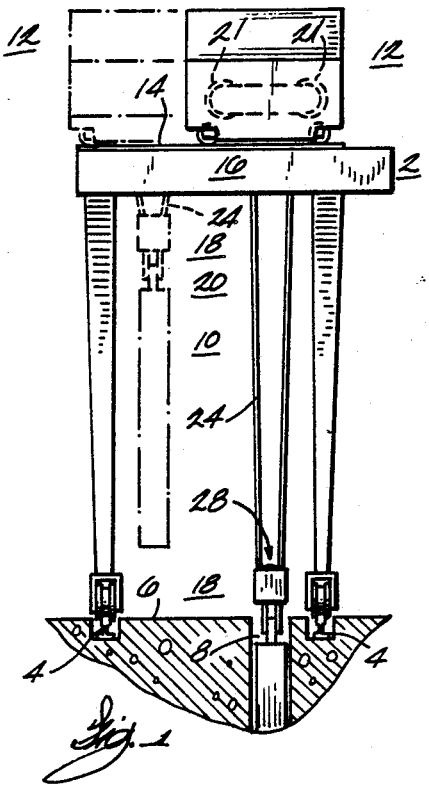
FIG. 1 is a front elevation view illustrating a gantry crane incorporating the linkage lifting apparatus of the invention.
Figure 2:
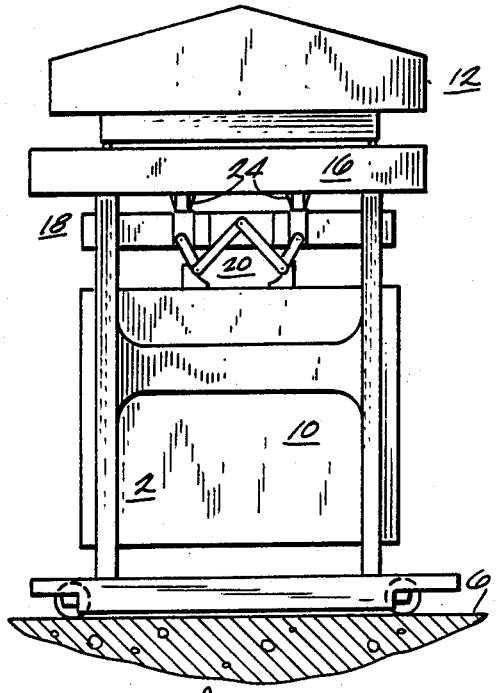
FIG. 2 is a side elevation view of the crane illustrated in FIG. 1.

Referring generally to FIGS. 1 and 2, a gantry crane is shown supported for travel along a pair of rails 4 comprising part of a gantry support in the top wall 6 of a dam. The top wall 6 of the dam includes a gate slot 8 in which is supported a spillway gate 10. The gate 10 may be raised or lowered to position it in the slot 8 or may be raised and removed entirely from the slot 8 and moved along the top of the dam wall 6 and set down at a different location on the dam wall or elsewhere within the travel area of the crane. The gantry crane includes a frame 2, a trolley 12 movable in a direction parallel to the width or thickness of the dam along a pair of tracks 14 supported on the top of the frame 2, a hoist 16 supported on the trolley 12, a lifting beam 18, and a linkage lifting means 20 attached to the lifting beam.

Figure 3:
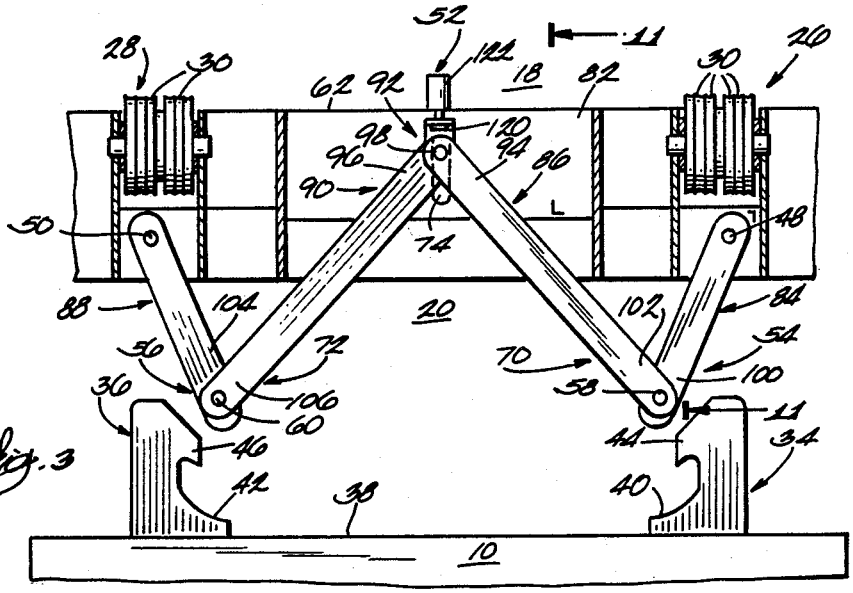
FIGS. 3–10 are enlarged front elevation views, broken away and partially in cross-section, illustrating the linkage lifting apparatus of the invention in a sequence of positions beginning with the position of a linkage lifting means prior to engaging lifting hooks of a load object as illustrated in FIG. 3 and ending with the position of the linkage lifting apparatus after release from the lifting hooks and while moving away from them, as illustrated in FIG. 9.

The trolley 12 includes a motor and gear drive 21, a drum 22 driven by the motor and gear drive 21, a cable 24 attached to the drum, and sheave means 23 and 25 through which the cable 24 is routed to the lifting beam 18. The drum 22 is rotated to take in or pay out the cable 24 to provide raising and lowering action for the hoist 16 and is well known and therefore will not be described herein in detail. The lifting beam 18 includes a pair of spaced apart sheave means 26 and 28 each preferably including a plurality of sheaves 30. The cable 24 is wound around the sheave means 26 and 28 on the sheaves 30 and attached to the frame 2, and provides lowering and raising force from the hoist 16 to the lifting beam 18 and through the linkage lifting means 20 to the spillway gate 10. The spillway gate 10 includes spaced apart hooks 34 and 36 positioned beneath the sheaves means 26 and 28, as illustrated in FIG. 3, and projecting in an upward direction. The hooks 34 and 36 respectively include facing guide surfaces 40 and 42 and hook projections 44 and 46 extending towards each other.

Figure 6:
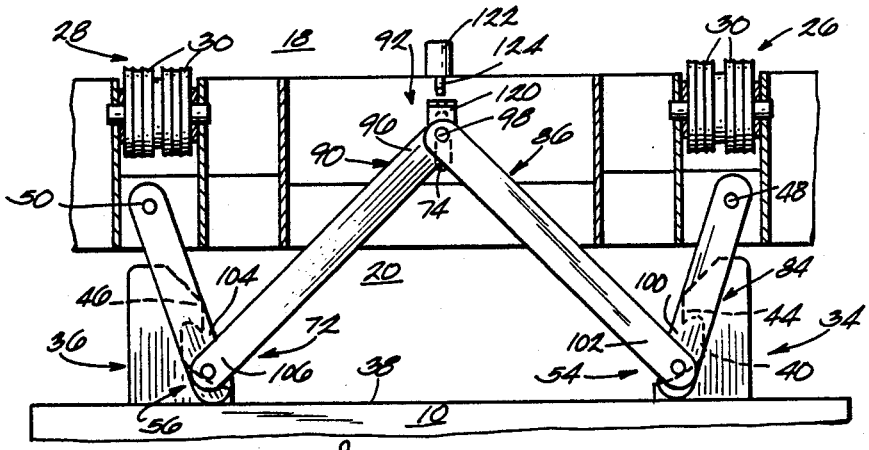

The linkage lifting means 20 is pivotally attached to the lifting beam 18 by pins 48 and 50 respectively positioned beneath the sheave means 26 and 28 and above the hooks 34 and 36. The linkage lifting means 20 includes a latching mechanism 52 which is illustrated in FIG. 3 holding the linkage lifting means 20 in an upward position prior to engagement of the linkage lifting means 20 with the hooks 34 and 36. The linkage lifting means 20 includes pivotal connections 54 and 56 including pins 58 and 60 which are respectively engageable with the hook projections 44 and 46 as illustrated in FIG. 6. When the pivotal connections 54 and 56 are in engagement with the hook projections 44 and 46 as illustrated in FIG. 6, the gate 10 may be raised or lowered by the hoist 16 and supported by the crane during a raising or lowering operation. With reference to the illustration of the trolley 12, lifting beam 18 and gate 10 in phantom lines in FIG. 2, when the hoist 16 has raised the gate 10 out of the slot 8, the gate 10 may be moved to one side of the slot 8 and supported at that location by the crane. Further, the gate 10 may be set down on the dam wall 6 to one side of the slot 8 or the gate 10 may be transported along the dam by travel of the crane on rails 4 and set down at a different location. Also, the hoist 16 may pick up a different gate and transport that gate to the slot 8 and lower it into a desired position.

Figure 10:
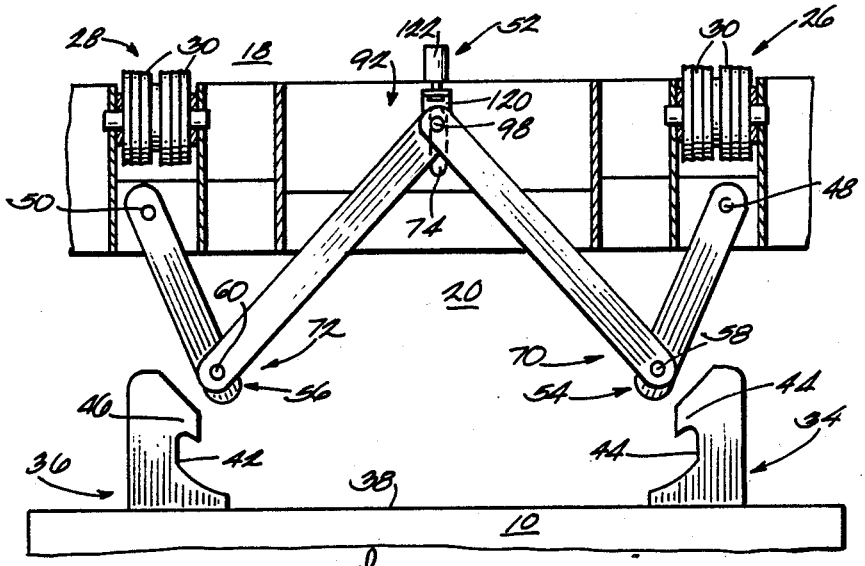
Figure 11:
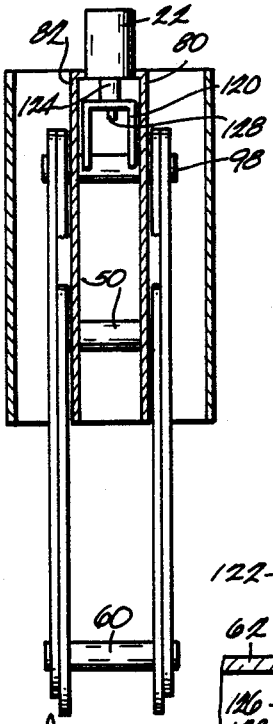
FIG. 11 is a side elevation view taken along lines 11—11 of FIG. 4, in cross-section and with portions of the apparatus removed for purposes of clarity.

Referring again to FIG. 3 and also with reference to FIG. 11, the linkage lifting means 20 includes a link pair 40 and a link pair 72 which are positioned and movably guided by double slot means 74 comprising vertical slots 76 and 78 in plates 80 and 82 of the lifting beam 18. The link pair 70 includes double link means 84 and double link means 86 pivotally connected together by the pivotal connection 54 at their respective ends 100 and 102. The link pair 72 includes double link means 88 and double link means 90 pivotally connected together by the pivotal connection 56 at their respective ends 104 and 106.. The double link means 84 and double link means 88 of link pairs 70 and 72 respectively pivotally connect the linkage lifting means 20 to the lifting beam 18 at the location of pins 48 and 50. The double link means 86 of link pair 70 and the double link means 90 of link pair 72 have a pivotal connection 92 comprising pin 98 extending through the end 94 of double link means 86 and the end 96 of double link means 90. As may be seen in FIGS. 3 and 10, the pin 98 extends through the slots 76 and 78 of the double slot means 74 and is movable in vertical directions in the slot means 74.

The latching means 52 comprises a slot member 120 mounted on the pin 98 and including a latching slot 130, and a plunger cylinder 122 mounted on a support wall 62 of the lifting beam 18, as shown in FIGS. 12–16. A plunger 124 is slidably mounted on the plunger cylinder 122 for movement into and out of the cylinder. The plunger 124 also rotates 45 degrees during each sliding movement into the cylinder and rotates a further 45 degrees in the same direction during sliding movement out of the cylinder. The plunger 124 includes a stem 126 carrying a latch head 128 at its distill end which is extendable through the slot 130. The latching means 52 is mounted in alignment with the length of the slot means 74 and the plunger 124 moves into and out of the plunger cylinder 122 also in alignment with the length of the slot means. Thus, as the pin 98 and the slot member 120 move along the slot means 74, the slot 130 in the slot member 120 will move into and out of engagment with the latch head 128 as determined by the rotational orientation of the latch head 128.

Figure 12:
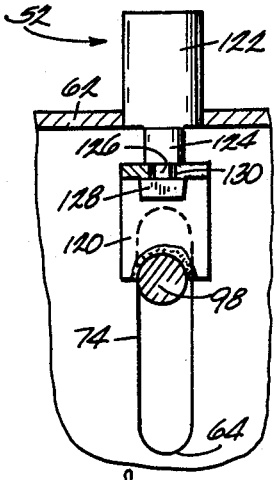
FIG. 12 is a front elevation view, partially in cross-section and broken away, illustrating a latch means utilized in the invention.
Figure 13:
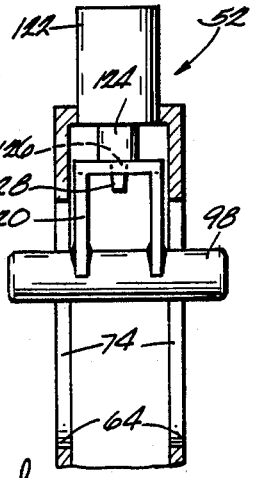
FIG. 13 is a side elevation view illustrating the latch means shown in FIG. 12.
Figure 14:
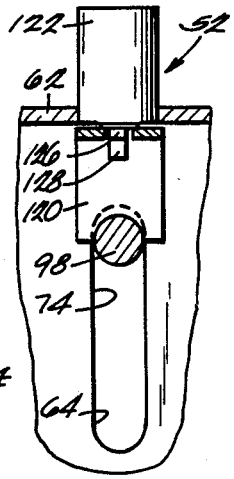
FIG. 14 is a front elevation view, partially in cross-section and broken away, illustrating the latch means shown in FIGS. 12 and 13 in another position during a release operation.

The plunger cylinder 122 is of a type well known in the art and therefore its operation will be described only to the extent of its function in cooperation with other components of the present invention. With reference to FIGS. 12 and 13, the latching means 52 is shown in a latched position in which the stem 126 is extended through the latching slot 130 and a latch head 128 is at a transverse right angle to the length of the latching slot 130. In this position of the latching means 52, the slot member 120 and therefore the pin 98 are held in a relatively upward position intermediate the lower end 64 and the upper end 66 of the slot means 74. Correspondingly, the holding of the pin 98 in the position illustrated in FIGS. 12 and 13 holds the link pair 70 and 72 in a high inclined position illustrated in FIGS. 3 and 4. In FIG. 14, the pin 98 and slot member 120 have been pushed upwards and in turn have pushed the plunger 124 into the cylinder 122. This movement of the plunger 124 into the cylinder 122 has resulted in rotation of the plunger 124 and the latch head 128 45 degrees and thus partially unlatching of the latch head 128 from the slot member 120. The position of the latching means 52 shown in FIG. 14 corresponds to the position of the link pair 70 and 72 illustrated in FIG. 5. In the upward movement of the pin 98 to cause the partial unlatching of the latch head 128 from the slot 130, it should be noted that the maximum upward travel of the pin 98 and thereby the slot member 120 which engages the plunger 124, is limited by the location of the upper end 66 of the slot means 74. Thus, movement of the plunger 124 further into the cylinder 122 then desired or unnecessary impact with cylinder 122 by the slot member 120 is avoided.

Figure 15:
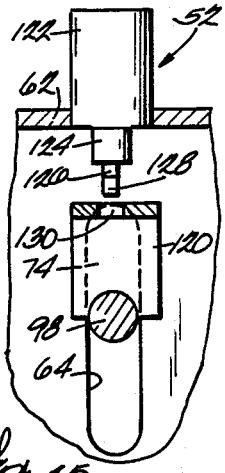
FIG. 15 is a front elevation view, partially in cross-section and broken away, illustrating the latch means shown in FIGS. 12–14 subsequent to a release operation.

In FIG. 15, the latching means 52 is shown in a fully unlatched position in which the pin 98 and slot member 120 have moved downward in the slot means 74 and the plunger 124 has moved out of the cylinder 122 to cause the latch head 128 to rotate an additional 45 degrees in the same direction as its previous 45 degree rotation. The additional 45 degree rotation has resulted in the latch head 128 becoming aligned in its longitudinal direction with the length of the slot 130 so that unlatching movement has been completed and the latch head 128 has released the slot member 120 to permit the pin 98 to move downward in response to the movement of the link pairs 70 and 72. The position of the latching means 52 in FIG. 15 corresponds to the position of the link pairs 70 and 72 shown in FIG. 6.

Figure 4:
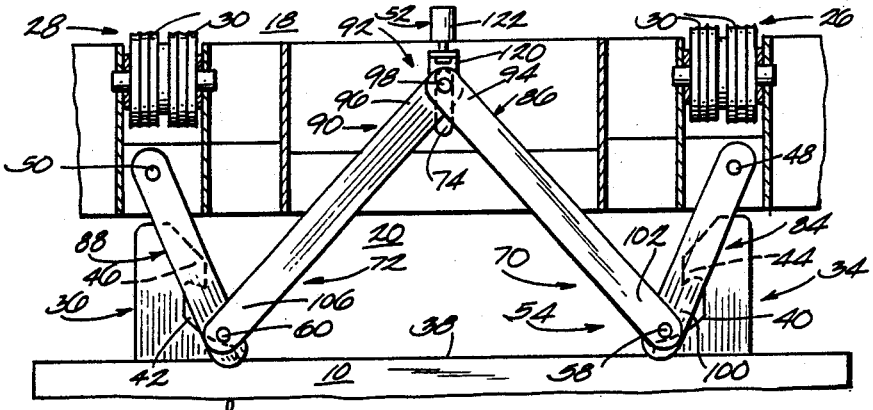
Figure 5:
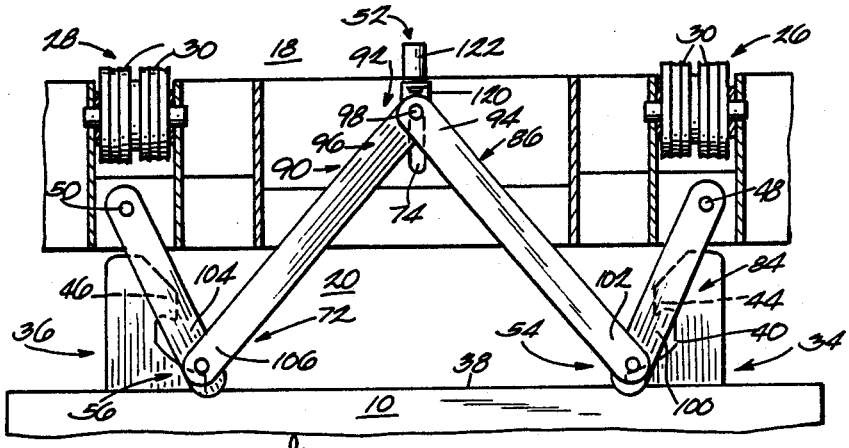

During the raising, lowering and transporting operation of the hoist 16, lifting beam 18 and linkage lifting means 20, the beam 18 and linkage lifting means 20 move through a succession of different positions relative to the hooks 34 and 36 of the gate 10. With reference to FIG. 3, the lifting beam 18 is moving the linkage lifting means 20 in a downward direction as indicated by the arrow in FIG. 3, toward the hooks 54 and 56 of the gate 10. While moving toward the hooks, the linkage lifting means 20 and its link parts 70 and 72 have a position in which the pivotal connection 92, previously described with reference to FIGS. 12 and 13, is held in a relatively upward position by the latching mechanism 52 and the pivotal connections 54 and 56 are respectively adjacent to the hook projections 44 and 46 but spaced apart a lesser distance than the hook projections. Thus, the pivotal connections 54 and 56 will pass the hook projections as they descend into engagement with the guide surfaces 40 and 42 of the hooks 34 and 36. FIG. 4 illustrates the link pair 70 and 72 in the same position relative to the beam 18 as is shown in FIG. 3 as the beam 18 is continuing to move downward. However, the link pair 70 and 72 are in a downward position in which the pivotal connections 54 and 56 are respectively below the hook projections 40 and 42, the pins 58 and 60 are respectively in engagement with the guide surfaces 40 and 42 of the hooks, the link means 86 and 90 are in a high inclined position and the pivotal connection 92 is still in the same position as shown in FIG. 3. In FIG. 5, the beam 18 and the link pair 70 and 72 are illustrated in their maximum downward position in which the lowering of the beam has pushed the pins 58 and 60 toward each other. Consequently, the pivotal connections 54 and 56 also have moved toward each other on the guide surfaces 40 and 42 of the hooks to and caused the link means 86 and 90 to move upward and the pivotal connection 92 to move upward in the slot means 74. Movement of the pivotal connection 92 upward has moved the slot member 120 upward in engagement with the plunger 124 and caused partial unlatching of the slot member 120 by the latch head 128, as shown in FIG. 14.

With reference to FIG. 6, the hoist 16 has begun to raise the lifting beam 18 and the linkage lifting means 20 so that the pivotal connections 54 and 56 have been freed to move further away from each other along the guide surfaces 40 and 42 of the hooks. The movement of the pivotal connections 54 and 56 away from each other also removes the upward force on the link means 86 and 90 so that they are free to move downward under the gravitational force of their own weight. As a result, the slot member 120 moves the latch head 128 downward and the plunger 124 and latch head 128 rotate an additional 45 degrees to release the slot member 120. Due to the downward movement of the pivotal connection 92 caused by the weight of the link means 86 and 90, the pin 98 moves to the position shown in FIG. 15 in which the link pair 70 and 72 have the position shown in FIG. 6 and they are fully unlatched from latching means 52.

Figure 7:
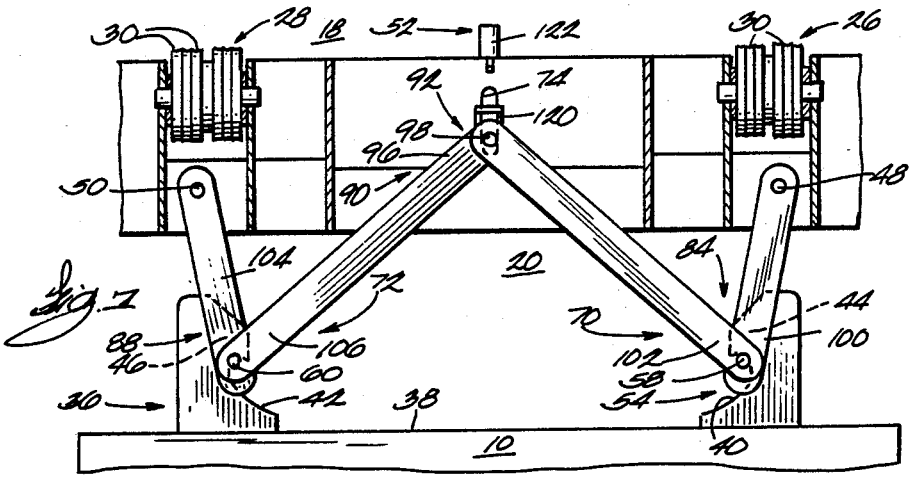
Figure 16:
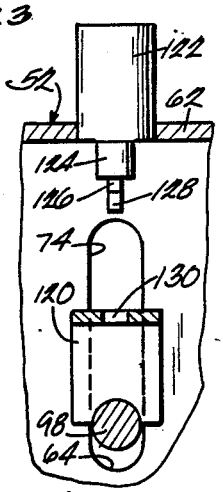
FIG. 16 is a front elevation view, partially in cross-section and broken away, illustrating the latch means shown in FIGS. 12–15 subsequent to a release operation.

As the hoist 16 continues to raise the lifting beam 18 as depicted by the arrow in FIG. 7, the weight of the link means 86 and 90 moves them to their low inclined position and move the pivotal connection 92 to its maximum downward position, shown in FIG. 16, and the pivotal connections 54 and 56 further away from each other along the guide surfaces 40 and 42 and respectively upward into engagement with the hook projections 44 and 46. The position of the link pairs 70 and 72 with the pivotal connections 92 at its maximum downward position, the pivotal connections 54 and 56 respectively engaging hook projections 44 and 46, and the link means 86 and 90 in a low inclined position is shown in FIG. 7. It should be noted that the spacing of the hooks 34 and 36 and the length of each of the link means 86 and 90 is such that the pin 98 is slightly above the bottom end 64 of the slot means 74, as shown in FIG. 16, at the maximum downward position of the pivotal connection 92. As a consequence, none of the load of the gate 10 being lifted as the beam 18 is raised is carried through the link means 86 and 90 and the pin 98. Very importantly, because the pin 98 does not engage the lower end 64 of the slot means 74, the entire load of the gate 10 is carried through the hooks 34 and 36, the pivotal connections 54 and 56, the link means 84 and 88, the pins 48 and 50 to the lifting beam 18, and through the sheave means 26 and 28 to the cable 24. Moreover, because the link means 84 and 88 are attached to the beam 18 beneath the sheaves 26 and 28 and the pivotal connections 54 and 56 engage the hooks 34 and 36 substantially beneath the sheave means 26 and 28, bending force on the lifting beam 18 is minimized or eliminated and the lifting force is applied along a substantially vertical line through the sheave means 26 and 28. Referring again to FIG. 2, the lifting beam 18 and linkage means 20 are shown in full lines in a lifting position corresponding to that shown in FIG. 7 as the gate 10 is about to be lifted out of the gate slot 8. Illustrated in FIG. 2 in phantom lines and in FIG. 1 in full lines, the lifting beam 18 and the linkage lifting means 20 are in a lifting position corresponding to FIG. 7 in which they are supporting the suspended gate 10.

Figure 8:
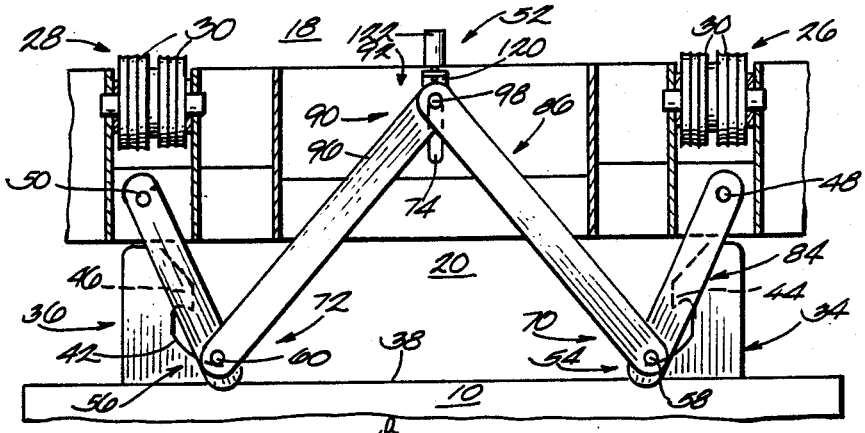
Figure 9:
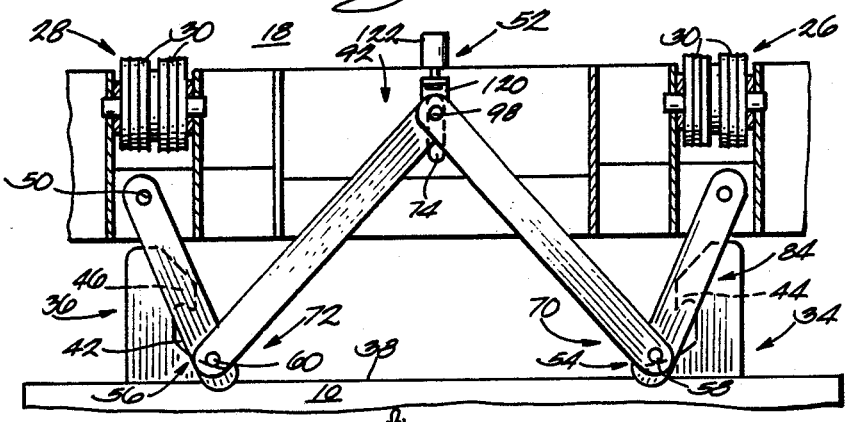

After a raising operation has been completed and it is desired to release the gate 10 at a different position in the slot 8 or lower and set the gate 10 down, the lifting beam 18 and the linkage lifting means 20 are lowered to the position shown in FIG. 8 as depicted by the arrow. The lifting beam 18 is in a position in FIG. 8 in which it has pushed the link means 84 and 88 downwardly so that the pivotal connections 54 and 56 are out of contact with the hook projections 44 and 46 and toward each other and the link means 86 and 90 and thereby the pivotal connection 92 have moved upward. The lifting beam 18, the link pairs 70 and 72, the pivotal connection 92 and the slot member 120 are in the same position in FIG. 8 as they are in FIG. 5, however, the rotation of the latch head 128 due to the movement of the plunger 124 into the cylinder 122 has caused the latch head 128 to rotate an additional 45 degrees to partially latch the pivotal connection 92 in its relatively upward position in the slot means 74. In this position of the latching mechanism 52, the latch head 128 has rotated 45 degrees three times from the position it has in FIGS. 3 and 4 so that the latch head now has advanced 135 degrees from its fully latched position shown in FIGS. 12 and 13. From the position shown in FIG. 8, the lifting beam 18 moves upward to the position shown in FIG. 9 in which downward force by the beam 18 on the link means 84 and 88 is removed. The weight of the link means 86 and 90 then causes the pivotal connection 92 to move downward so that the plunger 124 is extracted from the cylinder 122 and the latch head 128 rotates an additional 45 degrees to a fully latched position holding the pin 98 relatively upward in the slot means 74. During the additional downward movement of the link means 86 and 90, the pivotal connections 54 and 56 move slightly farther apart but nevertheless their spacing does not exceed a distance which prevents their passing upward adjacent to and between the hook projections 44 and 46. In FIG. 10, the lifting beam 18 and the linkage lifting means 20 are moving upward away from the hooks 34 and 36 as indicated by the arrow and the link pair 70 and 72 are in the same position as illustrated in FIGS. 3 and 4.

A lifting apparatus for use with a hoist or crane has been described in which the crane or hoist can be connected and disconnected from the load to be raised and lowered without manual assistance and which is simple and reliable in its operation. Further, the lifting apparatus utilizes a linkage means which permits the load to be lifted in substantially a direct line from the points of attachment to the load through wire ropes comprising part of the hoist mechanism so that bending forces on a lifting beam positioned between the load and wire rope are prevented.

It will be understood that the foregoing description of the present invention is for purposes of illustration only and that the invention is susceptible to a number of modification or changes, none of which entail any departure from the spirit and scope of the present invention as defined in the hereto appended claims.

What is claimed is:

1. In a crane for lifting an object comprising a load on the crane, the crane having a lifting beam movable in raising and lowering directions and carrying a pair of spaced apart beam sheave means, a hoist mounted adjacent the upper end of the crane above the lifting beam and having a wire rope wound around the beam sheave means for raising and lowering the beam, and linkage lifting means engageable with first and second load hooks of the object, the combination comprising:

a first link pair mounted on the lifting beam and having a first pivotal connection and a first link comprising a part of said first pivotal connection, the first link having a high inclined position and a low inclined position, the first pivotal connection having a position engaging the first hook when the first link is in the high inclined position and a position in lifting engagement with the first hook when the first link is in the low inclined position;

a second link pair mounted on the lifting beam and having a second pivotal connection and a first link comprising a part of said second pivotal connection, the second link having a high inclined position and a low inclined position, the second pivotal connection having a position engaging the second hook when the first link is in the high inclined position and a position in lifting engagement with the second hook when the first link is in the low inclined position;

the first link having a weight which causes a downward force on the first link, the first link and the first pivotal connection being movable from their respective high inclined position and position adjacent the first hook to their respective low inclined position and lifting engagement position with the first hook in response to the downward force on the first link;

the second link having a weight which causes a downward force on the second link, the second link and the second pivotal connection being movable from their respective high inclined position and position adjacent the second hook to their respective low inclined position and lifting engagement position with the second hook in response to the downward force on the second link; and means engaging the first and second link pair for holding the first and second link pair in the high inclined positions and being releasable from engagement with the first and second link pair to permit their movement to the low inclined positions.

2. The apparatus according to claim 1 wherein the lifting engagement position of the first pivotal connection and the lifting engagement position of the second pivotal connection are respectively in substantial vertical alignment with a different one of the beam sheave means.

3. The apparatus according to claim 1 or 2 wherein the first links of the first and second link pair have a third pivotal connection engaging the holding means in the high inclined position of the first links and the first links move from their high inclined to their low inclined position together.

4. The apparatus according to claim 3 further comprising slot means in which the third pivotal connection is vertically movable for guiding the movement of the third pivotal connection and thereby the first links during the movement of the latter from their high inclined to their low inclined positions.

5. In a crane for lifting an object comprising a load on the crane, the crane having a lifting beam movable in raising and lowering directions and carrying a pair of spaced apart beam sheave means, a hoist mounted adjacent the upper end of the crane above the lifting beam and having a wire rope wound around each of the beam sheave means for raising and lowering the beam, and linkage lifting means mounted on the lifting beam and engageable with first and second load hooks of the object, the combination comprising:

a first link pair comprising first and second links each including first and second ends, the first ends having a first pivotal connection attachable to the first hook of the object, the second end of the first link being pivotally connected to the beam;

a second link pair comprising third and fourth links each including first and second ends, the first ends of the second link pair having a second pivotal connection attachable to the second hook of the object, the second end of the third link being pivotally connected to the beam;

the second end of the second link of the first link pair and the second end of the fourth link of the second link pair having a third pivotal connection;

the first and second hooks are spaced apart and each have hook projections extending toward each other; and latch means mounted on the lifting beam and releasably connected to the third pivotal connection for holding the first and second link pair in a first position in which the first and second pivotal connections are adjacent to and spaced apart a lesser distance than the hook projections during lowering of the lifting beam enabling movement in a downward direction of the first and second pivotal connections to a second position of the first and second link pair in which the first and second pivotal connections are respectively below the first and second hook projections and for releasing the third pivotal connection in said second position of the first and second link pair whereby the first and second pivotal connections are free to move into engagement with the hook projections at a third position of the first and second link pair and, upon raising of the lifting beam, the object is raised and the load of the object is carried through the hook projections, the first and second pivotal connections, the first and third links, the lifting beam, and the wire rope.

6. The combination according to claim 5 wherein:

the first and second hooks respectively include first and second guide surfaces extending away from each other respectively toward the first and second hook projections;

the first and second pivotal connections respectively engage the first and second guide surfaces when the first and second link pair are in said second position;

the second and fourth links have a weight resulting in a downward force on the second and fourth links;

the third pivotal connection are movable downwardly in response to the downward force on the second and fourth links upon the release of the third pivotal connection by the latch means; and the first and second pivotal connections are movable respectively along the first and second guide surfaces away from each other and respectively toward the first and second hook projections in response to the weight of the second and fourth links moving the third pivotal connection downward.

7. The combination according to claim 5 wherein:

the lifting beam includes a vertical guide slot having upper and lower ends, the third pivotal connection being positioned in and vertically movable in the guide slot; and the third pivotal connection has a maximum lower position above the lower end of the guide slot whereby the third pivotal connection and thereby the second and fourth links do not carry any of the load of the object.

8. The combination according to claim 5 wherein:

the second and fourth links have a weight resulting in a downward force on the second and fourth links;

the third pivotal connection is movable downwardly in response to the downward force on the second and fourth links upon the release of the third pivotal connection by the latch means; and the first and second pivotal connections are movable away from each other and into engagement respectively with the first and second hook projections in response to the weight of the second and fourth links moving the third pivotal connection downward.

9. The combination according to claim 8 wherein:

the load object has a stationary position upon a support surface;

the first and second link pair are movable, in response to lowering of the lifting beam and when the object is in said stationary position, from the third position in which the first and second pivotal connections are in engagement respectively with the first and second hook projections to a fourth position in which the first and second pivotal connections have moved toward each other and are respectively below the first and second hook projections and are spaced apart a lesser distance that the hook projections whereby the lifting beam and linkage lifting means may be raised away from the object;

the lifting beam includes a vertical guide slot, the third pivotal connection being positioned in and vertically movable in the guide slot; and the first and second link pair, in moving from said third position to the fourth position, are movable downwardly relative to the load object and the third pivotal connection is movable upwardly in the guide slot into holding engagement with the latch means whereby the first and second link pair are held in the fourth position and the lifting beam and linkage apparatus may be raised away from the supported object.

10. The combination according to claim 9 wherein:

the first and second hooks respectively include first and second guide surfaces extending away from each other respectively toward the first and second hook projections;

the first and second pivotal connections respectively engage the first and second guide surfaces and are guided by the guide surfaces in their movement both away from and toward each other.

11. The combination according to claim 10 wherein:

the vertical guide slot has a lower end; and the third pivotal connection has a maximum lower position spaced from the lower end of the guide slot whereby the third pivotal connection and the second and fourth links do not carry any of the load of the object.

12. The combination according to claim 5 or 11 wherein:

a first one of the pair of sheave means, the connection of the first link to the beam, and the attachment of the first pivotal connection to the first load hook are substantially in vertical alignment; and the second one of the pair of sheave means, the connection of the third link to the beam, and the attachment of the second pivotal connection to the second load hook are substantially in vertical alignment.

13. The combination according to claim 5 wherein:

the lifting beam includes a vertical guide slot having an upper end, the third pivotal connection being positioned in and movable along a vertical path in the guide slot; and the latch means includes a body member above the slot and aligned with the path of movement of the third pivotal connection, and a latch head extending from the body member downward into said path, the latch head having a position in holding engagement with the third pivotal connection as the latter moves vertically in the slot, the upper end of the slot engaging the third pivotal connection during upward movement of the latter at a position below the body member whereby impacting engagement of the third pivotal connection with the body member is prevented.

14. The combination according to claim 5 wherein:

the load object has a stationary position upon a support surface; and the first and second link pair are movable, in response to lowering of the lifting beam and when the object is in said stationary position, from the third position in which the first and second pivotal connections are in engagement respectively with the first and second hook projections to a fourth position in which the first and second pivotal connections are respectively below the first and second hook projections and are spaced apart a lesser distance than the hook projections whereby the lifting beam and linkage lifting means may be raised away from the object.

15. The combination according to claim 14 wherein, in moving from said third position to the fourth position, the first and second link pair are movable downwardly relative to the load object.

16. In a crane for lifting an object comprising a load on the crane, the crane having a lifting beam movable in raising and lowering directions and carrying a pair of spaced apart beam sheaves, a hoist mounted adjacent the upper end of the crane above the lifting beam and having a wire rope wound around the beam sheaves for raising and lowering the beam, and linkage lifting means mounted on the lifting beam and attachable to first and second load hooks of the object, the combination comprising:

a first link pair comprising first and second links each including first and second ends, the first ends having a first pivotal connection, the first link being pivotally connected at its second end to the lifting beam beneath a first one of the pair of sheaves, the first pivotal connection being attachable to the first load hook beneath the first one of the sheaves;

a second link pair comprising third and fourth links each including first and second ends, the first ends having a second pivotal connection, the third link being pivotally connected to the lifting beam beneath a second one of the pair of sheaves, the second pivotal connection being attachable to the second load hook beneath the second one of the sheaves;

the second link of the first link pair and the fourth link of the second link pair having a third pivotal connection at their second ends; and latching means connectable to the third pivotal connection of the first and second link pair for holding the first and second link pair in a position enabling attachment of the first and second pivotal connections respectively to the first and second load hooks whereby, upon raising of the lifting beam, the load object is raised and the load of the object is carried by the wire ropes through the pair of sheaves, the beam, the first and third links, and the first and second load hooks.

17. The combination according to claim 16 wherein:

said first one of the pair of sheaves, the connection of the first link to the beam, and the attachment of the first pivotal connection to the first load hook being substantially in vertical alignment; and said second one of the pair of sheaves, the connection of the third link to the beam, and the attachment of the second pivotal connection to the second load hook being substantially in vertical alignment.

* * * * *